US005284036A

United States Patent [19]

Rosenbaum

[11] Patent Number: 5,284,036

[45] Date of Patent: Feb. 8, 1994

[54] TAMPER-RESISTANT SECURITY LOCK FOR CARGO CONTAINER DOORS

[76] Inventor: Nathan B. Rosenbaum, 6401 SW. 82 St., Miami, Fla. 33143

[21] Appl. No.: 984,378

[22] Filed: Dec. 2, 1992

[51] Int. Cl.[5] ..... B65D 45/16

[52] U.S. Cl. ..... 70/14; 70/56; 70/200; 70/212; 70/DIG. 65; 292/218; 292/258

[58] Field of Search ..... 70/14, 18, 19, 54–56, 70/199, 200, 211, 212, 238, DIG. 65; 292/258, 259, 205, 218, DIG. 32

[56] References Cited

U.S. PATENT DOCUMENTS

| | | | |
|---|---|---|---|
| 1,639,870 | 8/1927 | Valsvig | 292/205 X |
| 2,479,300 | 8/1949 | Binz | 70/19 |
| 3,736,016 | 5/1973 | Garvey et al. | 70/56 X |
| 3,926,018 | 12/1975 | Joersz | 292/258 X |
| 4,003,227 | 1/1977 | Casey | 70/19 X |
| 4,372,136 | 2/1983 | Mickelson | 70/14 |
| 4,389,862 | 6/1983 | Hastings | 70/54 X |
| 4,819,462 | 4/1989 | Apsell | 70/226 X |
| 5,082,213 | 1/1992 | Torres | 70/200 X |
| 5,145,222 | 9/1992 | Meyer | 70/202 X |
| 5,165,263 | 11/1992 | Perron et al. | 70/212 X |

FOREIGN PATENT DOCUMENTS

| | | | |
|---|---|---|---|
| 1026347 | 4/1953 | France | 70/14 |
| 135411 | 4/1952 | Sweden | 70/14 |
| 2110175 | 6/1983 | United Kingdom | 70/14 |

*Primary Examiner*—Lloyd A. Gall
*Attorney, Agent, or Firm*—Dennis H. Lambert

[57] ABSTRACT

A tamper-resistant security lock assembly for use on lockrods of cargo container doors to prevent unauthorized opening of the doors. The lock assembly includes a pair of adjustably telescopically interengaged hasps with hook configurations on opposite ends adapted to connect with the lockrods in spanning relationship to a door opening and prevent opening of the door. A plurality of openings are formed through the hasps in positions to be in registry with one another when the hasps are appropriately adjusted relative to one another, for receiving a staple and padlock to lock the hasps against relative movement. According to one feature of the invention, the openings in one hasp are spaced differently than the openings in the other hasp, whereby smaller increments of adjustment can be obtained than if the openings were all spaced the same. In accordance with another feature of the invention, an elongate guard is carried on one end of one of the hasps in position to overlie and prevent operation of the lock arm connected with a lockrod. Preferably, the staple is connected to the hasp through a pivotal support that is designed to fail before failure of the staple itself whenever an effort is made to pry or break the staple or lock, and the guard is connected to the hasp through a connection designed to fail before damage occurs to the hasps, thereby maintaining the hasps in operative condition whenever an attempt is made to break the lock assembly.

12 Claims, 8 Drawing Sheets

TAMPER-RESISTANT SECURITY LOCK FOR CARGO CONTAINER DOORS

TECHNICAL FIELD OF THE INVENTION

This invention relates to locking devices, and more particularly, to a tamper-resistant security lock or shackle for securing locking members against unauthorized opening movement.

BACKGROUND ART

Cargo containers are widely used for shipping goods by land, air and sea. These containers are typically large rectangular structures specially designed to be handled and stored in the holds of ships, and on railway flat cars and the like. Further, upon reaching major shipping distribution points, the cargo containers may be adapted for use as trailers used in the trucking industry, so that they may be transported to local distribution points.

These cargo containers typically have caster supports and sill structure at their bottom edges, and are closable by pivoted doors held in closed position by lockrods extending vertically over the doors and into cooperating detents fixed on the surrounding door frame. Lock arms are attached to these lockrods to pivot them about their longitudinal axis for release from the detents, whereby the pivoted doors may be opened. During storage and shipment, these lock arms are locked in closed position by padlocks or the like to prevent pivoting movement of the lockrods and unauthorized access to the contents of the containers.

Unfortunately, theft has become a major problem with such containers because of the manner in which they are used. That is, such containers are frequently left untended for varying periods of time in storage facilities, or even on railway flat cars during transportation from one site to another. Thieves can relatively easily break open the pivoted doors and gain access to the goods inside by using pry bars, hammers, saws and other tools to break the lock on the lock arms, thereby enabling the lockrods to be pivoted to their open position.

Various devices have been developed in the prior art for deterring such theft by making it more difficult to break into the containers. Two examples are shown in U.S. Pat. Nos. 4,372,136 and 4,389,862. In both of these patents, the security lock comprises two J-shaped hasps for hooking engagement over the lockrods in spanning relationship to the doors of the container. A staple on one of the hook members is receivable in one of a plurality of openings in the other to lock the two hasps in assembled relationship on the lockrods so that they cannot be moved apart relative to one another. So long as the lock assembly remains secured in spanning relationship to the cargo doors they cannot be opened, even if the lockrods are disengaged from their detents.

The assemblies in these two patents are adjustable to accommodate different spacing between lockrods, with the increments of adjustment being dependent upon the spacing of slots or grooves in only one of the hook members. Further, the padlocks used to secure the two hook members together are in relatively exposed positions, making it easier to break the lock and gain access to the contents of the cargo container.

In order to reduce the amount of space required for storing and shipping such containers, particularly in the holds of ships and the like, it is essential that the containers be capable of close-fitting relationship with one another. Consequently, it is desirable that nothing be provided on the exterior of the container that protrudes beyond the sill and/or caster support, since any item protruding beyond these extremities on a container can cause damage to an adjoining container when they are being placed or moved in the hold of a ship or other storage facility. Thus, a bulky lock assembly cannot be used that projects beyond the plane of the caster assembly or sill on the container. The two patents mentioned above appear to satisfy this criteria, but fail to solve the additional problems noted.

Accordingly, there is need for a simple and inexpensive security lock that can be used to secure the doors on cargo containers against unauthorized opening movement, wherein the assembly does not project beyond predetermined limits from the container side wall, and wherein the padlock is shielded from access by destructive tools, and a wide range of relatively small increments of adjustment can be obtained to accommodate a wide variety of prior art door constructions.

DISCLOSURE OF THE INVENTION

It is therefore a primary object of this invention to provide a simple and inexpensive tamper-resistant security lock assembly which can be used to secure the doors on a cargo container against unauthorized opening movement, in which the lockable component of the assembly is shielded from access by tools intended to damage or defeat the lock, and wherein the assembly has a low profile and has structure providing for small increments of adjustment, so that a better fit can be obtained with a wide variety of container door structures.

In accordance with the present invention, a pair of complementary, J-shaped hook members are adapted to engage at one of their ends around a pair of spaced apart lockrods and to be telescopically engaged at their other ends for adjustment to accommodate differently spaced lockrods. A pivotally supported staple is positioned to extend through aligned openings in the telescopically engaged ends of the two members, and an opening is formed through it for receipt of a padlock to secure the staple in place and thereby lock the two members against movement relative to each other.

A horizontal cover plate on one of the hook members overlies the padlock and defines a shield to prevent access from above to the padlock with a pry bar, bolt cutter or the like, while the hook members themselves prevent access to the padlock from the front of the device. An adjustably positioned retaining member and combined cover is associated with the cover plate and has one end extending downwardly in shielding relationship to one side of the padlock and another end extending angularly into contact with the adjacent lockrod to frictionally hold the assembly against vertical sliding movement on the lockrod.

The lock assembly of the invention is rendered virtually fail safe by break-away features which cause failure of various components while preserving the integrity of essential structural elements that maintain the assembly in locked condition, thereby assuring the safety of the container contents.

Means is also provided on the assembly of the invention for attaching a shipping seal, whereby breaking of the seal will necessarily occur whenever the device is opened.

In a modification of the invention, a guard projects from one end of the assembly in a position to cover one end of the lock handle used to operate the lockrod, whereby the lockrod cannot be rotated to an opened position without first defeating the lock assembly of the invention. This guard is preferably attached to the assembly by a break-away connection that causes the guard to fail before catastrophic damage occurs to the assembly itself, thereby insuring the integrity of the primary function of the assembly.

BRIEF DESCRIPTION OF THE DRAWINGS

The foregoing, as well as other objects and advantages of the invention, will be apparent from the following detailed description when considered in conjunction with the accompanying drawings, wherein like reference characters designate like parts throughout the several views, and wherein.

Figure 1:
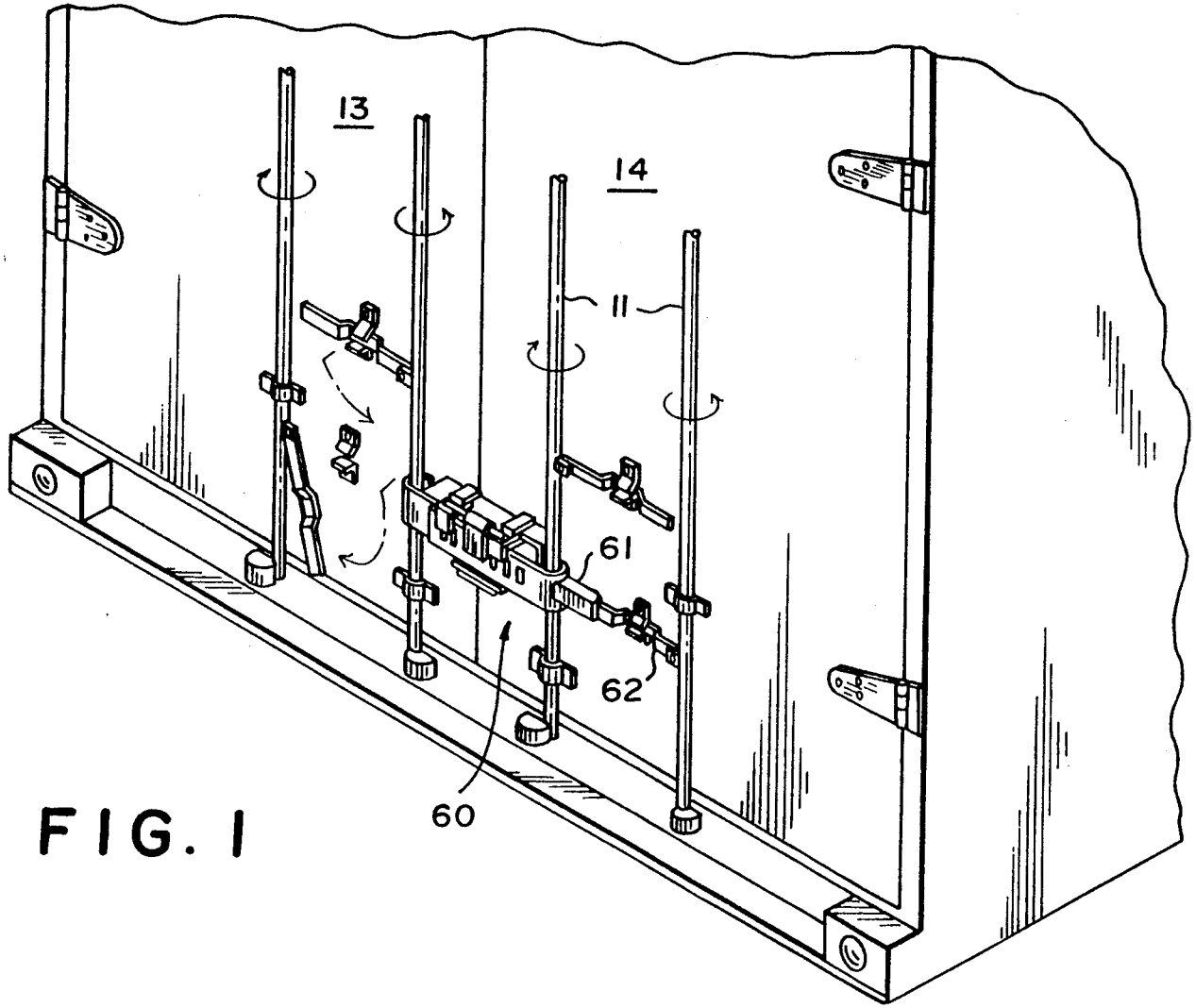
FIG. 1 is a fragmentary perspective view of a cargo container having pivoted doors and locking rods, with the security lock assembly of the invention shown assembled thereto.
Figure 2:
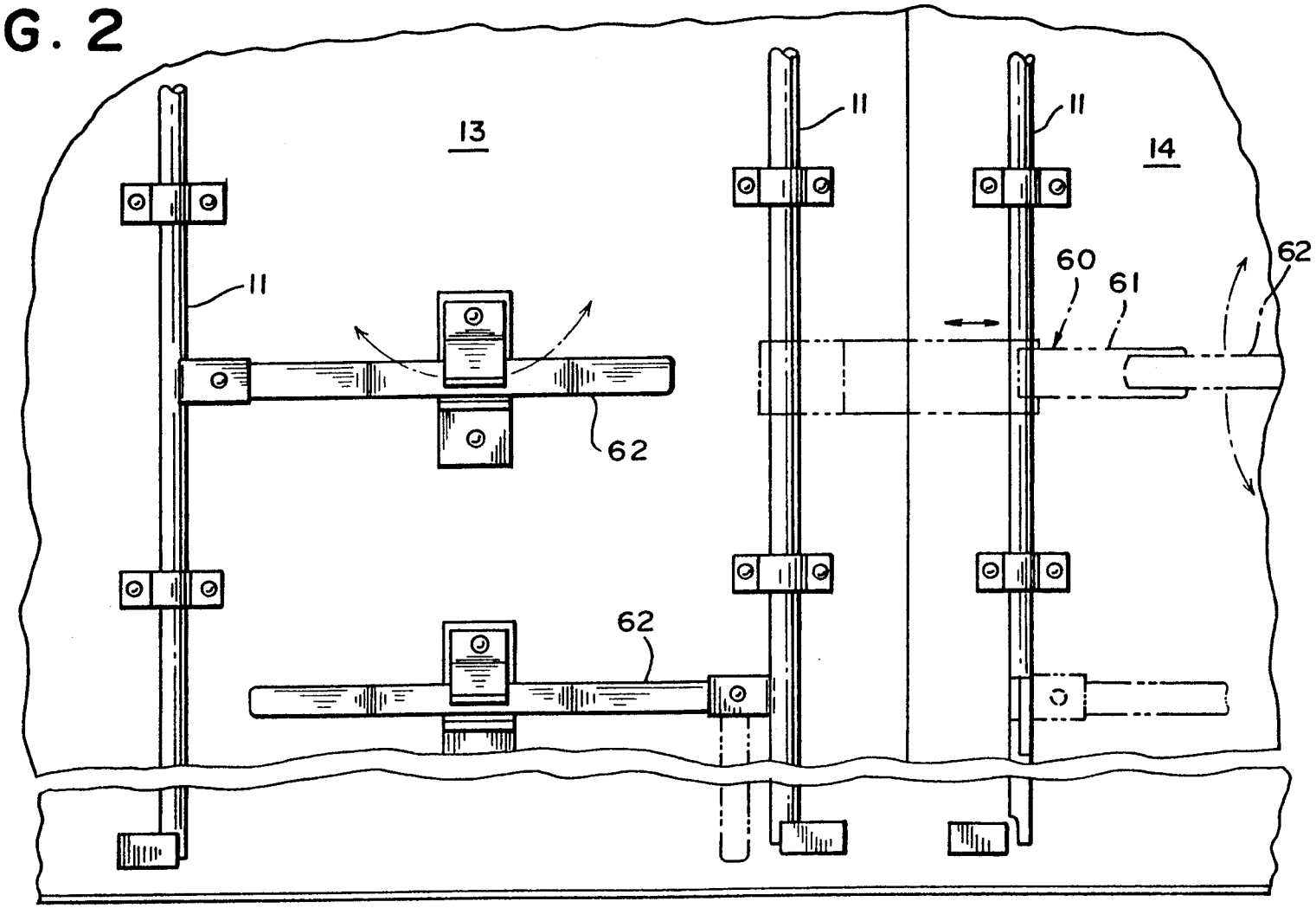
FIG. 2 is an enlarged, fragmentary view in elevation of a portion of the doors and lockrod assembly of a typical cargo container.
Figure 3:
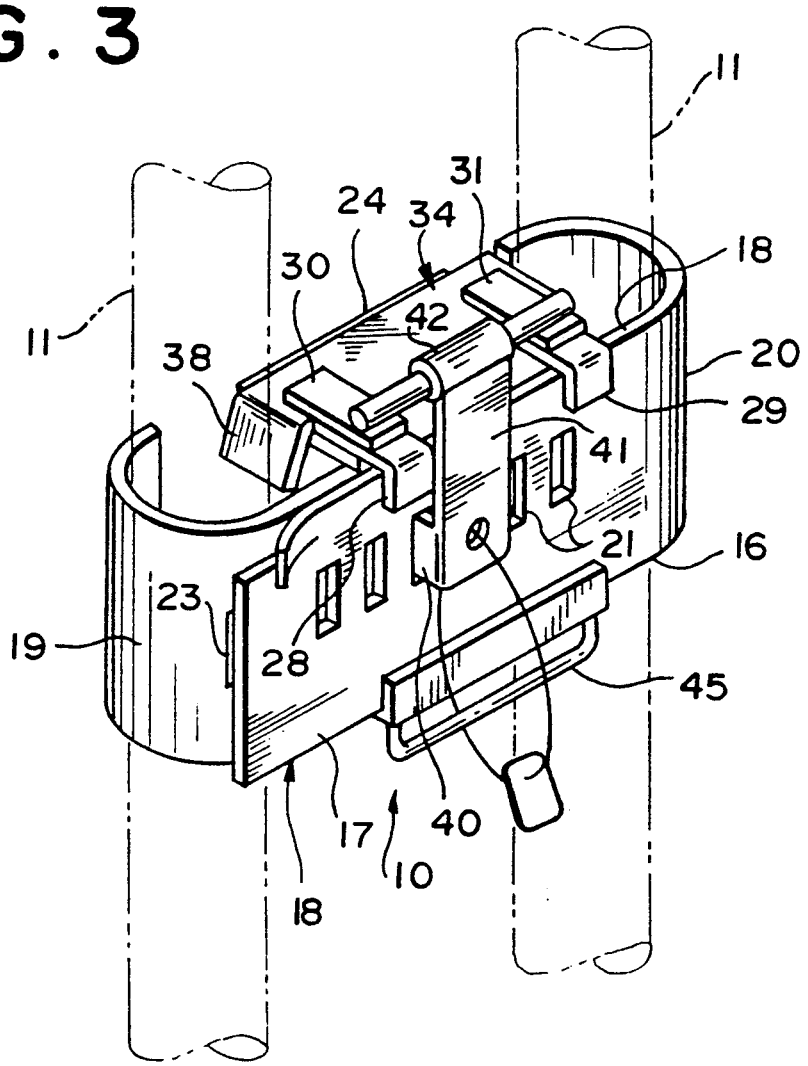
FIG. 3 is an enlarged, fragmentary, perspective view of the lock assembly of the invention, shown assembled on two adjacent lockrods.
Figure 7:
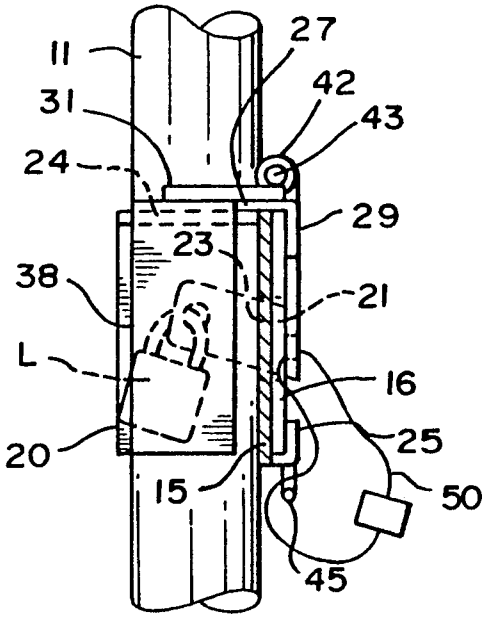
FIG. 7 is a transverse sectional view taken along line 7—7 in FIG. 5.
Figure 4:
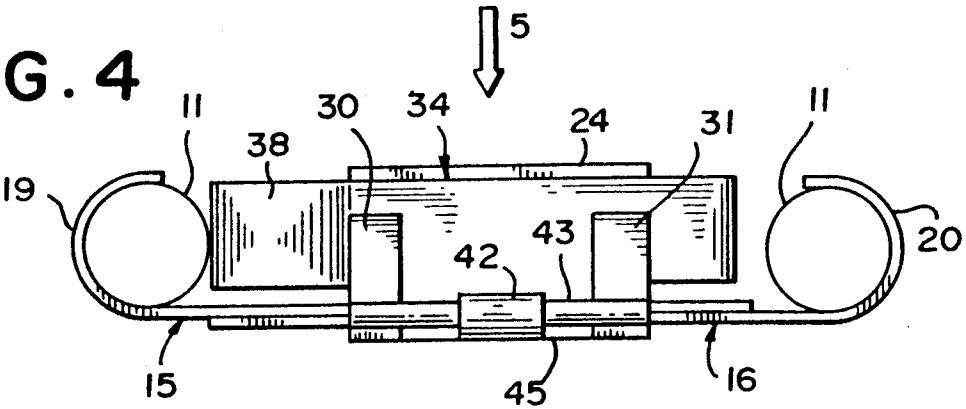
FIG. 4 is a top plan view of the lock assembly of the invention, shown assembled on a pair of lockrods and depicting how a retaining plate on the assembly contacts one of the lockrods to prevent sliding movement of the assembly along the lockrods.
Figure 5:
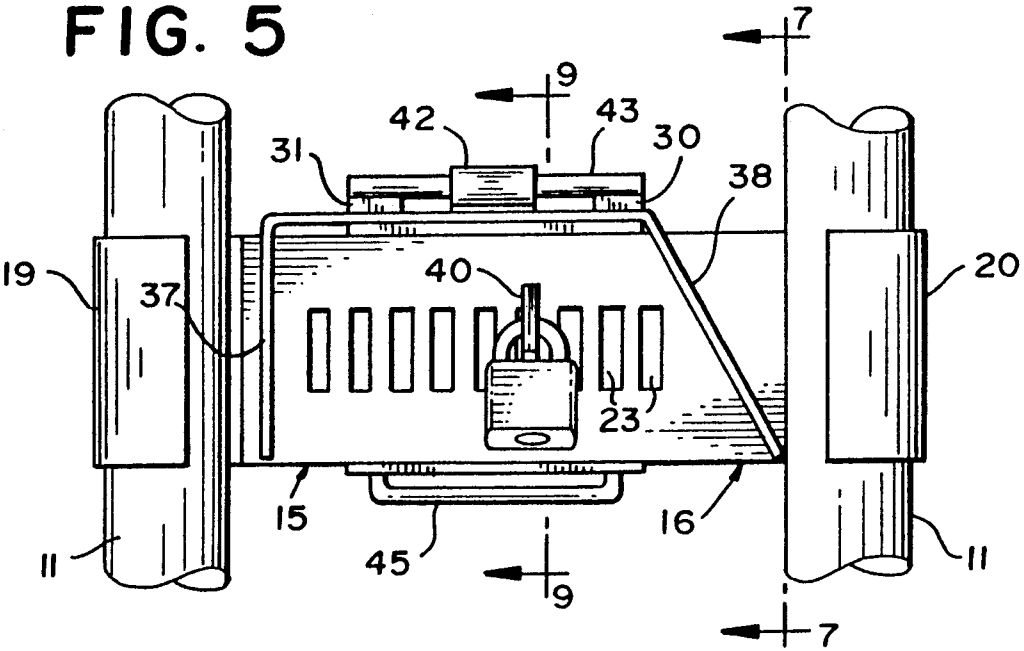
FIg. 5 is a rear view in elevation of the assembly of FIG. 4, taken in the direction of the arrow "5" in FIG. 4.
Figure 6:
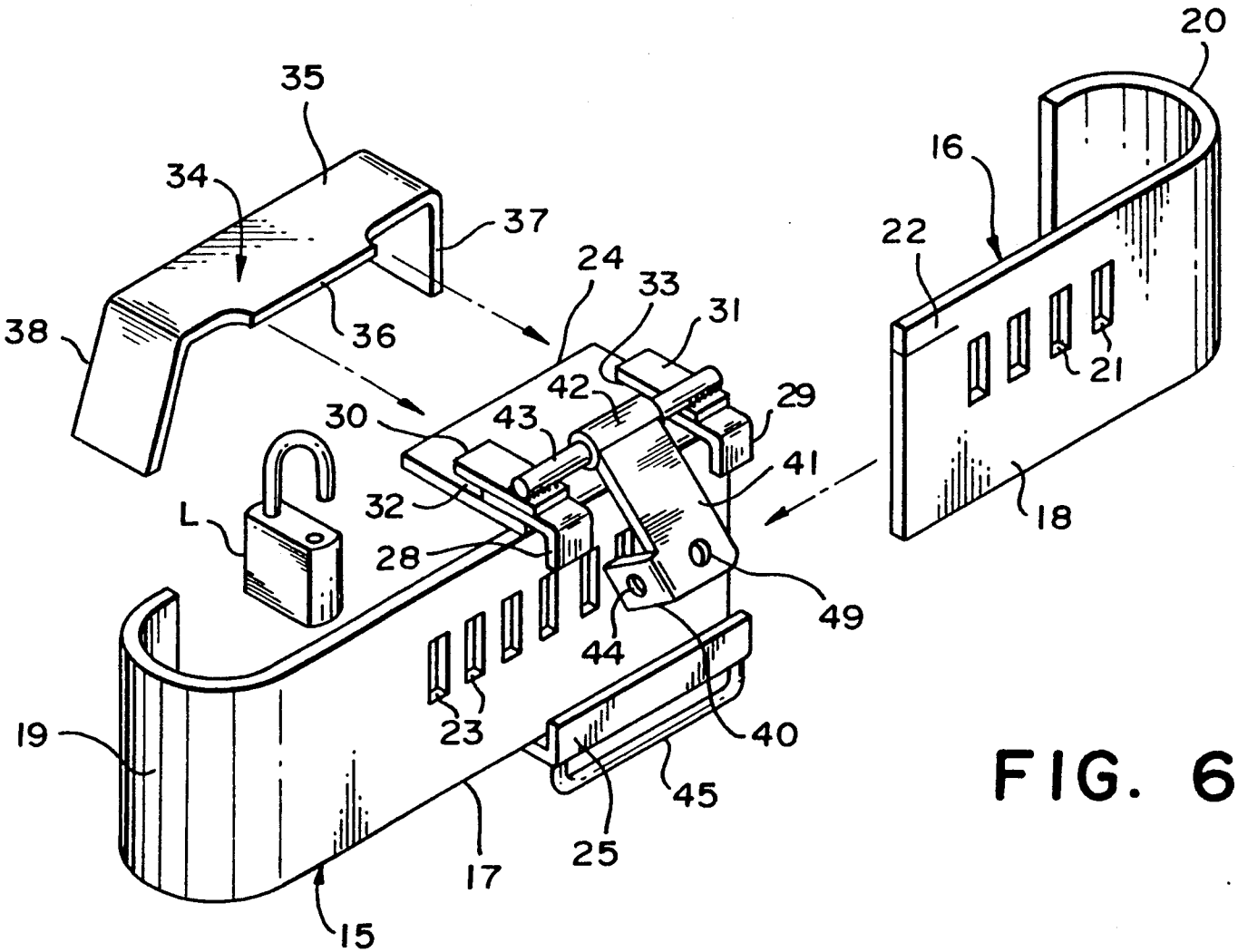
FIG. 6 is an exploded perspective view of the assembly of the invention.
Figure 9:
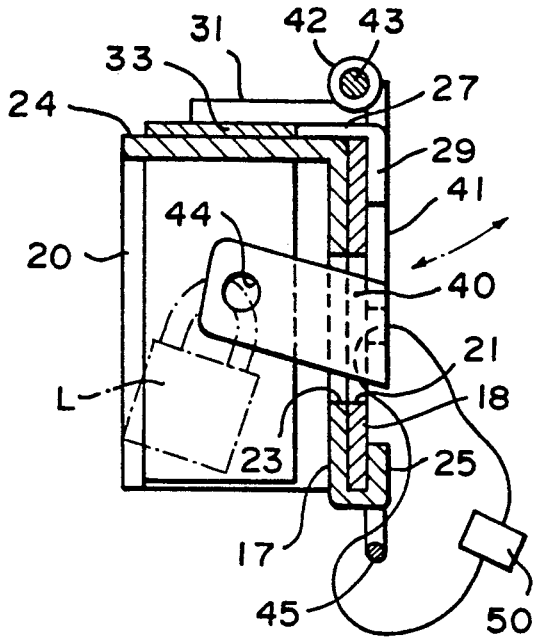
FIG. 9 is a transverse sectional view taken along line 9—9 in FIG. 5, with the retaining plate removed for purpose of clarity.

BEST MODE OF CARRYING OUT THE INVENTION:

Referring more specifically to the drawings, a tamper-resistant security lock assembly 10 according to the invention is shown assembled to the lockrods 11 of a cargo container 12, in spanning relationship to the pivoted doors 13 and 14 to prevent opening of the doors even if the lockrods are moved to their opened positions.

As shown best in FIGS. 3-9, the lock assembly 10 comprises a pair of J-shaped hook members or hasps 15 and 16 having substantially flat, elongate bodies 17 and 18, respectively, with hooks 19 and 20 at one of their respective ends adapted to engage around an associated lockrod 11 on a container door.

The body 18 of hasp 16 has a plurality of narrow, elongate slots 21 formed therethrough in aligned, parallel relationship to one another, and a bendable tab 22 is formed at an upper end corner to prevent disengagement of the two hook members after they have been assembled to one another.

A plurality of corresponding slots 23 are formed through the body 17 of hasp 15 in positions to be in registry with the slots in hasp 16 when the two members are in operative association with one another.

Figure 8:
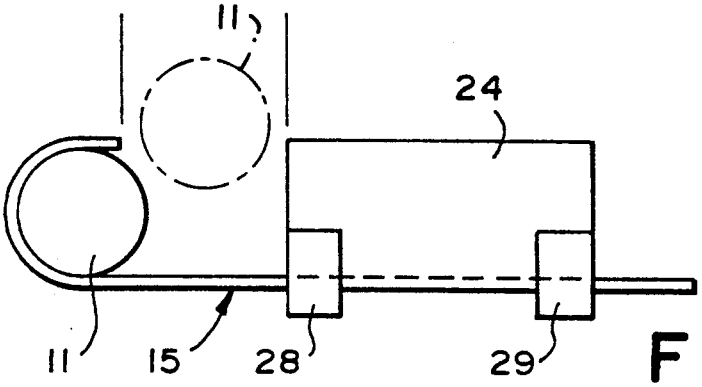
FIG. 8 is a somewhate schematic top plan view of one of the hasps, showing the clearance space between the hook and the top plate.
Figure 10:
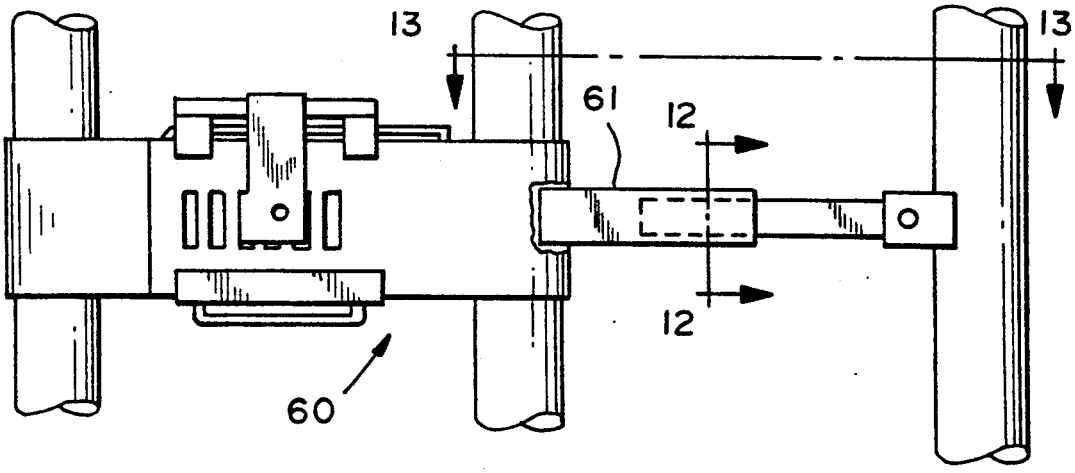
FIG. 10 is a fragmentary front view in elevation of a modified lock assembly in accordance with the invention, wherein a guard extends from one end for covering relationship with a lock handle for preventing actuation of the handle and associated lockrod.
Figures 11, 12:
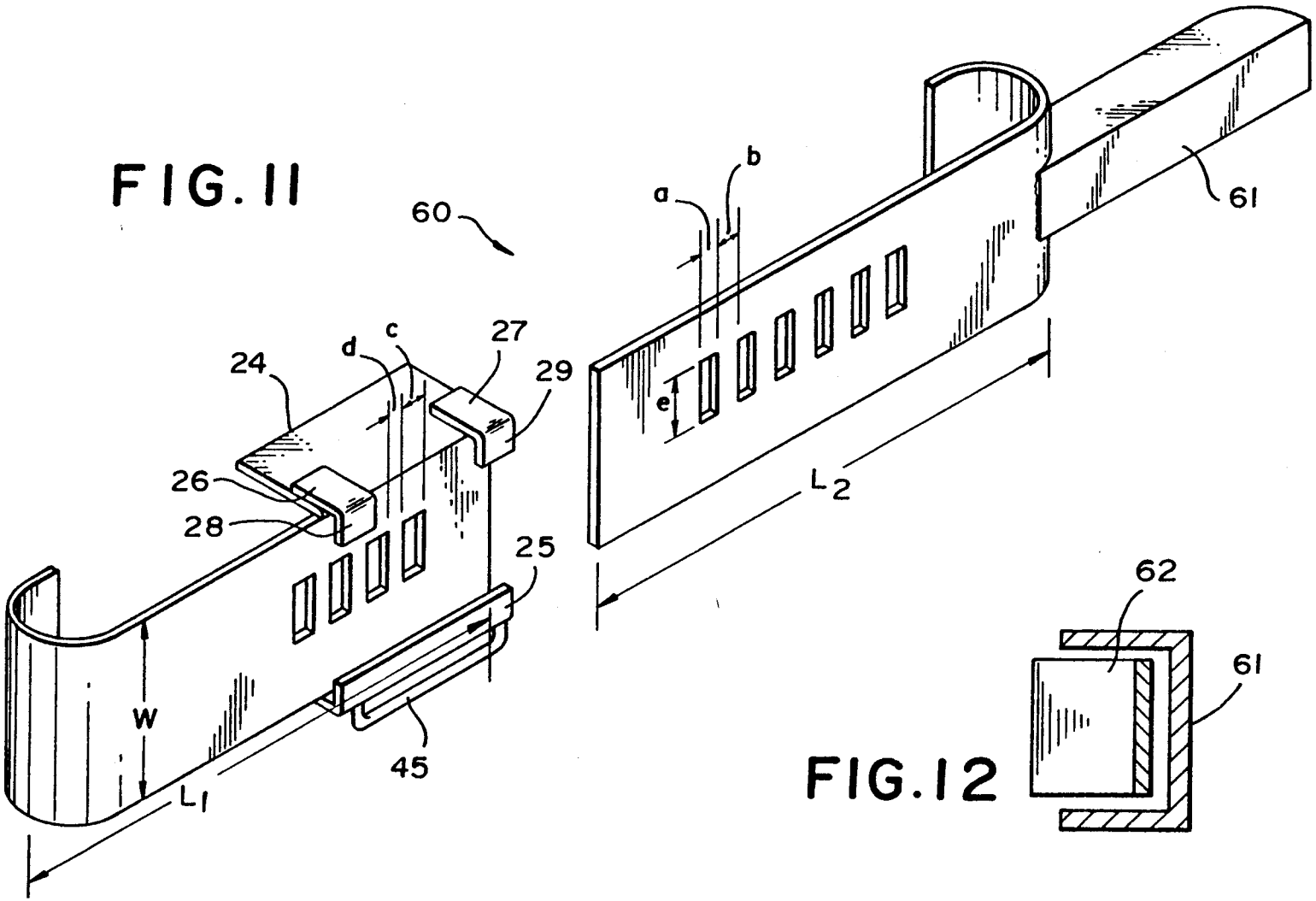
FIG. 11 is an enlarged, exploded perspective view of the hook members or hasps of the modified lock assembly of FIG. 10.
FIG. 12 is a transverse sectional view taken along line 12—12 in FIG. 10.
Figure 13:
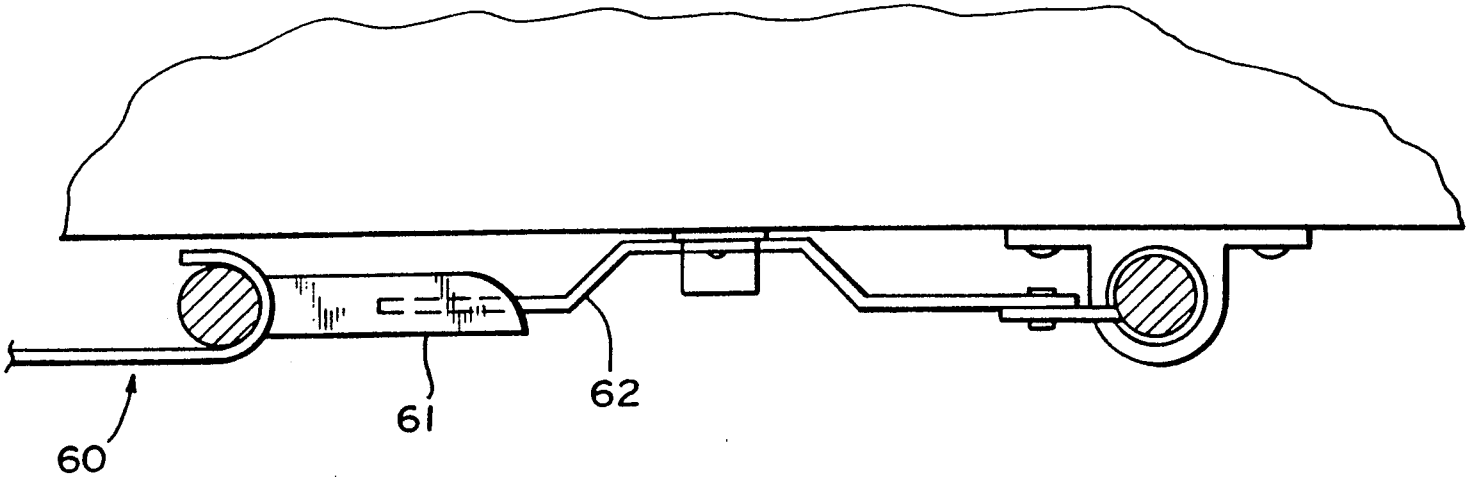
FIG. 13 is a horizontal sectional view taken along line 13—13 in FIG. 10.

Further, and with particular reference to FIG. 8, the body 17 of hasp 15 has a rearwardly directed lip or plate 24 on its upper edge, and a forwardly directed guide channel 25 on its lower edge, each extending along the same portion of the length of the body 17.

A pair of tabs 26 and 27 are welded on top of the plate 24 at its opposite edges and are bent downwardly parallel to the face of body 17, spaced outwardly therefrom, to define guides 28 and 29 in opposed alignment with the guide 25 at the bottom edge of the body. These guides receive the body 18 of hasp 16 and hold the hasps 15 and 16 in telescopic, sliding relationship to one another. After the end of body 18 is inserted through the guides 25 and 28-29, the bendable tab 22 is bent to form a stop to prevent the hasps 15 and 16 from becoming disengaged from one another.

A pair of retaining straps 30 and 31 are welded on top of the tabs 26 and 27 and extend rearwardly over the plate 24 in spaced relationship to it, defining spaces 32 and 33 for receiving a combined shield and retaining plate 34 that slides between the straps 30 and 31 and the plate 24. As seen best in FIG. 6, the retaining plate 34 has a top portion 35 that lies flat against the plate 24, with a forwardly projecting tab 36 that extends between the tabs 30 and 31, a first end portion 37 that extends downwardly perpendicularly to the top portion 35, and a second end portion 38 that extends downwardly at an obtuse angle to the plate 35. The first end portion 37 defines a shield to block access to the padlock from that side, and the second end portion 38 may be engaged against the side of the adjacent lockrod 11 to frictionally hold the lock assembly in position on the lockrod when the lock assembly is disengaged by removing staple 40 from the slots and sliding hasp 16 out of engagement with its associated lockbar and with hasp 15 (see FIG. 5). The second end portion also defines a shield to block access to the padlock from that side.

The retaining plate 34 is located vertically with respect to the hasp 15 by the plate 24 and straps 30 and 31, and is retained horizontally by engagement of the end portions 37 and 38 on opposite sides of the plate 24 and by the tab 36 on plate 34 which extends between the guides 28 and 29. However, the plate 34 has a slight amount of play so that it may be selectively engaged and disengaged from the lockrod, or to position it or remove it, as desired, without the use of tools.

The hasps 15 and 16 are locked against sliding movement relative to one another by a staple 40 carried on the bottom end of a pivot arm 41 that is welded at its upper end to a slide tube 42 pivotally and slidably received on pivot rod 43 welded to the top of retaining straps 30 and 31.

In use, the hasps 15 and 16 are slid relative to one another to a desired adjusted position, with a selected pair of the slots 23 and 21 in registry with one another, and the staple 40 inserted through the aligned slots to block any further sliding movement of the hasps relative to one another. If necessary, the staple assembly may be slid along pivot rod 43 to align it with a pair of aligned slots. A padlock L is then locked on the staple behind the hasps, with the shackle of the padlock inserted through an opening 44 in the end of the staple to prevent withdrawal of the staple through the slots. As seen best in FIGS. 6 and 8, the staple extends upwardly at an angle to the axis of the pivot arm 41 to enable it to clear the bottom ends of the slots during its movement through them.

A shipping seal 50 may be secured to the staple and to a U-shaped rod 45 welded to the bottom of the guide 25, by passing the wire or strap of the seal through an opening 46 in the staple and behind the rod 45, as seen best in FIG. 8.

The pivot arm 41 is welded to the slide tube 42, and the pivot rod 43 is welded to the straps 30 and 31 by relatively weak welds which are designed to fail before catastrophic damage can occur to the operative components of the lock assembly whenever an attempt is made to break the lock by use of a pry bar, hammer or other tool. If any of these welds are broken, the staple still cannot be pulled or pushed through the slots, and the hasps therefore cannot be slid relative to one another to disengage the hooked ends 19 and 20 from an associated lockrod.

The slots 21 in hasp 16 are spaced differently than the slots 23 in hasp 15, and the slots all have a predetermined width so that a greater number of smaller increments of adjustment can be obtained than if the slots in both hasps were all spaced the same distance apart.

A modification of the invention is indicated generally at 60 in FIGS. 9–12, and is essentially identical to the first form of the invention, expect that a guard 61 is welded to the hooked end of one of the hasps in a position to extend in overlying relationship to the lock arm 62 that is secured to the lockrod to operate the lockrod, and prevents operation of the lock arm when the lock assembly 60 and guard 61 are in operative position.

The guard is welded to the end of the hasp by a relatively weak weld so that the weld will fail when an effort is made to pry or hammer against the guard, thereby protecting the lock assembly itself from failure.

In a specific embodiment constructed in accordance with the invention, the hasps comprise cold-rolled steel, having a width W of about four inches and a thickness of about three-sixteenths of an inch. The hasp 15 has an overall length $L_1$ of about nine inches, or more, if desireable or necessary, and the hasp 16 has an overall length $L_2$ (not counting the guard) of about fifteen inches, or more, if desireable or necessary. The slots 21 in hasp 16 have a width "a" of about one-quarter of an inch and are spaced apart a distance "b" of about one-half of an inch, while the slots 23 in hasp 15 have a width "c" of about one-quarter of an inch but are spaced apart a distance "d" of about three-eighths of an inch. All of the slots have a length "e" of about one and one-quarter inch, or other length as necessary to accomodate the staple. The tabs 26 and 27 defining the guides 28 and 29 may be made of three-quarter inch angle iron. With these dimensions, and with the ability to slide the staple along its pivot, a pair of slots can be aligned for receipt of the staple in increments of adjustment of three-sixteenths of an inch.

The security lock assembly of the invention is simple and inexpensive to make, does not require any tools to apply and remove from the lockrods of a cargo container, and is virtually immune to destruction with tools typically used by thieves. It is compact in design, and does not extend beyond the sill plate or caster assemblies on cargo containers, whereby it is suitable for use on cargo containers that are intended to be stored in close proximity to one another, such as in the hold of a ship or the like.

While the invention has been illustrated and described in detail herein, it is to be understood that various modifications may be made therein without departing from the spirit and scope of the invention, as defined by the appended claims.

What is claimed is:

1. A security lock assembly for preventing unauthorized opening of doors to containers having lockrods for locking the doors closed, and lock arms connected to the lockrods for actuating the lockrods, wherein at least one door has an edge movable with respect to another member to form a door opening, comprising:

a pair of adjustably telescopically interengaged hasps having means on outer ends thereof for connection with a pair of lockrods spaced on opposite sides of the door opening to prevent movement apart of said lockrods and thus prevent opening of said door in an adjusted position of said hasps;

means for locking said hasps in said adjusted position to thereby prevent disengagement of said hasps from said lockrods; and an elongate guard secured on one end of one of the hasps in a position to extend into covering relationship to at least a portion of a lock arm to prevent actuation of the lock arm and thus prevent operation of an associated lockrod when the security lock assembly is in operative position on a pair of spaced lockrods.

2. A security lock assembly as claimed in claim 1, wherein:

said guard is connected to said hasp by a connection that is designed to fail when a tool is used to pry or hammer on said guard in an effort to break said lock assembly, thereby preventing disablement of said lock assembly.

3. A security lock assembly for preventing unauthorized opening of doors to containers having lockrods for locking the doors closed, wherein at least one door has an edge movable with respect to another member to form a door opening, comprising:

a pair of telescopically adjustably interconnected J-shaped hasps each having a hook member on one end for close fitting encircling relationship with a respective lockrod, and having an elongate rectangularly shaped body extending from the hook member toward an opposing lockrod, wherein the lockrods are spaced on opposite sides of the door opening, to thereby hold the lockrods toward one another and prevent opening of said door;

each hasp having a plurality of openings formed therethrough in positions to be in registry with one another when the hasps are adjustably interconnected;

staple means pivotally carried by one of the hasps and including a portion for extending through a pair of openings in the two hasps when those openings are in registry with one another in an adjusted position of the hasps, to thereby secure the hasps in their adjusted position;

the openings in one of the hasps being spaced closer together than the openings in the other hasp, with the differently spaced openings in the two hasps defining a vernier adjustment, whereby smaller increments of adjustment can be obtained than if the openings were equally spaced; and lock means for engagement on said staple means behind said hasps, between the hasps and said door, to lock the hasps in their telescopically adjusted position and prevent opening of the door.

4. A security lock assembly as claimed in claim 3, wherein:

the hasps are J-shaped, with a hook member on one end of each J-shaped hasp for connection with a lockrod, and an elongate body extending from the hook member; and guide means on the elongate bodies for holding the hasps in mutually telescopic, sliding relationship to one another.

5. A security lock assembly as claimed in claim 4, wherein:

the openings formed through the hasps comprise a plurality of elongate slots in the elongate bodies, said slots having their longitudinal axes oriented transverse to the longitudinal axis of the respective elongate body.

6. A security lock assembly as claimed in claim 3, wherein:

said staple means is connected to one of said hasps through a pivotal support means on one of the hasps for pivotal movement between a first position with the staple means extended through an aligned pair of said openings to hold the hasps in adjusted position, and a second position withdrawn from said aligned openings so that said hasps may be moved longitudinally relative to one another to release the lockrods and permit opening of the door, said staple means including a first portion which extends through said aligned openings and a second portion extending angularly from the first portion to said pivotal support means; and said second portion of said staple means being connected to said pivotal support means through a connection that is designed to fail before the first portion fails or is withdrawn from the openings when a pry bar or hammer or other tool is used in an effort to break said security lock, to thereby prevent disengagement of the first portion from the openings and thus prevent relative longitudinal sliding movement of the hasps.

7. A security lock assembly as claimed in claim 3, wherein:

an elongate guard is secured on one end of one of the hasps in a position to extend into covering relationship to at least a portion of a lock arm to prevent actuation of the lock arm and thus prevent operation of an associated lockrod when the security lock assembly is in operative position on a pair of spaced lockrods.

8. A security lock assembly as claimed in claim 7, wherein:

the guard is connected to the hasp through a connection that is designed to fail when a tool is used to pry or hammer on the guard in an effort to break the lock assembly, thereby preserving the function of the telescopically engaged hasps.

9. A security lock assembly for preventing unauthorized opening of doors to containers having lockrods for locking the doors closed, wherein at least one door has an edge movable with respect to another member to form a door opening, comprising:

a pair of adjustably interconnected hasps having means thereon for connection with a pair of lockrods spaced on opposite sides of the door opening to hold the lockrods toward one another and prevent opening of the door;

said hasps each having a plurality of openings therethrough adapted to be placed in registry with one another in adjusted positions of the hasps;

staple means connected by pivotal support means on one of the hasps for pivotal movement between a first position with the staple means extended through an aligned pair of said openings to hold the hasps in adjusted position, and a second position withdrawn from said aligned openings so that said hasps may be moved longitudinally relative to one another to release the lockrods and permit opening of the door, said staple means including a first portion which extends through said aligned openings and a second portion extending angularly from the first portion to said pivotal support means; and said second portion of said staple means being connected to said pivotal support means through a connection that is designed to fail before the first portion fails or is withdrawn from the openings when a pry bar or hammer or other tool is used in an effort to break said security lock, to thereby prevent disengagement of the first portion from the openings and thus prevent relative longitudinal sliding movement of the hasps.

10. A security lock assembly as claimed in claim 9, wherein:

the hasps are relatively thin, wide, J-shaped flat pieces of metal shaped at one end to define hooks which comprise the means for connection with a lockrod, and each includes an elongate body portion through which said plurality of openings are formed for receiving the staple means, said first portion of said staple means having a hole therethrough for receiving the shackle of a padlock to lock the staple means in place with the first portion inserted through an aligned pair of said openings; and one of said J-shaped hasps having a generally horizontally extending plate or flange projecting rearwardly from an upper edge thereof, defining a shield that overlies the padlock to protect it against access from above with tools intended to break and open the padlock.

11. A security lock assembly as claimed in claim 10, wherein:

a retaining plate is releasably and adjustably carried by one of the hasps in overlying relationship to the horizontally extending plate, and includes a first leg extending angularly downwardly from one end thereof in a position to engage against a lockrod with which said hasp is connected, to frictionally retain said lock assembly in place on said lockrod.

12. A security lock assembly as claimed in claim 11, wherein:

said retaining plate includes a second leg extending downwardly from the other end thereof, defining a shield to protect the padlock against access from the side with a tool intended to break and open the padlock.

* * * * *